US010010782B2

(12) United States Patent
Damiani

(10) Patent No.: US 10,010,782 B2
(45) Date of Patent: Jul. 3, 2018

(54) HEEL-PIECE FOR BINDING A BOOT ON A GLIDING BOARD

(71) Applicant: SALOMON S.A.S., Metz-Tessy (FR)

(72) Inventor: Laurent Damiani, Villaz (FR)

(73) Assignee: SALOMON S.A.S., Metz-Tessy (FR)

( * ) Notice: Subject to any disclaimer, the term of this patent is extended or adjusted under 35 U.S.C. 154(b) by 17 days.

(21) Appl. No.: 14/865,319

(22) Filed: Sep. 25, 2015

(65) Prior Publication Data

US 2016/0089592 A1 Mar. 31, 2016

(30) Foreign Application Priority Data

Sep. 26, 2014 (FR) ..... 14 02176

(51) Int. Cl.

| | |
|---|---|
| ***A63C 9/082*** | (2012.01) |
| ***A63C 10/08*** | (2012.01) |
| ***A63C 9/00*** | (2012.01) |
| ***A63C 9/08*** | (2012.01) |
| ***A63C 9/084*** | (2012.01) |
| ***A63C 9/086*** | (2012.01) |

(52) U.S. Cl.

CPC ..... *A63C 10/08* (2013.01); *A63C 9/006* (2013.01); *A63C 9/082* (2013.01); *A63C 9/086* (2013.01); *A63C 9/0807* (2013.01); *A63C 9/0845* (2013.01)

(58) Field of Classification Search

None

See application file for complete search history.

(56) References Cited

U.S. PATENT DOCUMENTS

| | | | | |
|---|---|---|---|---|
| 4,401,318 A * | 8/1983 | Beyl | A63C 9/001 | 280/625 |
| 8,746,728 B2 * | 6/2014 | Shute | A63C 7/1013 | 280/607 |
| 8,820,772 B2 * | 9/2014 | Andersson | A63C 9/006 | 280/614 |

(Continued)

FOREIGN PATENT DOCUMENTS

| | | |
|---|---|---|
| DE | 10 2011 078834 A1 | 1/2013 |
| EP | 0 199 098 A2 | 10/1986 |

(Continued)

*Primary Examiner* — Paul N Dickson
*Assistant Examiner* — Vaughn Coolman
(74) *Attorney, Agent, or Firm* — Greenblum & Bernstein, P.L.C.

(57) ABSTRACT

The invention relates to a heel-piece for binding a boot on a gliding board that includes a frame including a vertical extension; a body rotatably mounted about the extension; at least two rods supported by the body, extending on respective sides of the vertical extension, the two rods each having a free end to cooperate with a housing in the heel of the boot; and a holding mechanism for maintaining a spacing between the free ends of the rods. The vertical extension supports at least one contact zone fixed in relation to the frame. Each rod cooperates with a respective portion of the contact zone, specific to each rod. The contact zone is arranged such that a rotation of the body about the extension, from a descent configuration, causes an increased spacing between the two rods. The invention also relates to a binding system and a gliding board equipped with such a binding.

18 Claims, 11 Drawing Sheets

(56) References Cited

U.S. PATENT DOCUMENTS

| | | | | |
|---|---|---|---|---|
| 8,919,805 | B2 * | 12/2014 | Giordani | A63C 9/006 280/614 |
| 9,016,712 | B2 * | 4/2015 | Giordani | A63C 9/006 280/614 |
| 9,022,410 | B2 * | 5/2015 | Giordani | A63C 9/006 280/614 |
| 9,242,167 | B2 * | 1/2016 | Shute | A63C 7/102 |
| 2011/0175328 | A1 | 7/2011 | Indulti | |
| 2012/0042542 | A1 | 2/2012 | Lehner | |
| 2013/0181427 | A1 * | 7/2013 | Fritschi | A63C 9/007 280/614 |
| 2014/0110919 | A1 | 4/2014 | Convert | |

FOREIGN PATENT DOCUMENTS

| | | | |
|---|---|---|---|
| EP | 2 345 462 | A1 | 7/2011 |
| EP | 2 345 463 | A1 | 7/2011 |
| EP | 2 384 794 | A1 | 11/2011 |
| EP | 2 420 306 | A1 | 2/2012 |
| EP | 2 570 160 | A1 | 3/2013 |
| WO | WO-2009/105866 | A1 | 9/2009 |
| WO | WO-2012/024809 | A1 | 3/2012 |

* cited by examiner

HEEL-PIECE FOR BINDING A BOOT ON A GLIDING BOARD

CROSS-REFERENCE TO RELATED APPLICATION

This application is based upon French Patent Application No. FR 14/02176, filed Sep. 26, 2014, the disclosure of which is hereby incorporated by reference thereto in its entirety, and the priority of which is claimed under 35 U.S.C. § 119.

BACKGROUND

1. Field of the Invention

The present invention relates to a binding for binding a boot to a gliding board. The invention relates in particular to the rear portion of a binding for binding a boot on a gliding board, such binding referred to as the heel-piece. The invention includes a particularly advantageous application of a binding for alpine ski boot bindings and, in particular, for the so-called ski touring bindings.

2. Background Description

In the descent, or descent phase, a solution for fixing a boot to a gliding board, such as a ski, involves using a front portion of the binding, referred to as the toe-piece, designed to affix the front of the boot to the board, and a heel-piece to fix the heel of the boot to the board.

According to an embodiment disclosed in the document AT 402 020, the heel-piece supports two rods each having a free end which is adapted to penetrate into a respective corresponding housing formed in the heel of the boot as disclosed, for example, in the document EP 0 199 098.

When the heel of the boot is to be fixed to the board, it suffices to bring the heel downward, which results in a collaboration between the two rods and the heel. The two rods then engage in the housing of the heel and block it. The heel is then affixed to the board and thus ensures proper retention of the foot when gliding.

In certain situations, for example in the event of a fall of the user, the boot must be capable of being released immediately from the binding. For this purpose, the binding incorporates one or more mechanisms that enable automatic release of the boot in the area of the heel-piece and/or in the area of the toe-piece. This function is called a "release".

Thus, in certain constructions, such as those disclosed in the documents WO 2012/024809, US 2013/0181427, WO 2009/105866, EP 2 570 160, and U.S. Pat. No. 8,820,772, the release can be performed essentially by the heel-piece. This release occurs as a result of a substantial force directed:

- either vertically, that is to say, the heel is lifted from the gliding board along a direction substantially perpendicular to the upper surface of the gliding board. This release is called a "vertical release" and occurs after a forward fall of the skier;
- or laterally, that is to say, the heel is disengaged from the gliding board along a circular arc, the vertical axis of rotation of which is substantially at the front of the boot. In general, the release is generated by a torque exerted on the boot about this vertical axis of rotation. This torque can be transposed by a force along a direction substantially transverse to the gliding board, i.e., substantially perpendicular to the longitudinal direction of the gliding board. This release is called a "lateral release". During lateral release, the body of the heel-piece which supports the rods is rotationally driven about an axis perpendicular to the upper surface of the gliding board.

The general principle of blocking the heel-piece, as well as the mechanisms enabling the automatic vertical and lateral releases in the event of fall are described below.

The heel-piece generally comprises a plurality of holding mechanisms, typically springs, which exert a force tending to move the two free ends of rods closer to one another or to return them to a neutral position. The distance between the two free ends of the rods is thus constrained elastically.

Typically, as illustrated in the documents EP 2 420 306, US 2012/0042542, and EP 0 199 098, the boot heel housing defines two guiding paths symmetrical in relation to a median axis of the foot. Each of the two guiding paths has an engagement zone in which a rod of the heel-piece is adapted to penetrate when the heel gets close to the heel-piece. Each of the two guiding paths is then extended by a guiding zone in which one of the rods is guided until reaching a blocking zone. In this configuration, the heel is held firmly in the heel-piece, both vertically and laterally. During insertion of the heel of the boot in the heel-piece, the two guiding zones, each associated with a rod, mutually space apart the two ends of the rods, which come closer together upon reaching the blocking zone. From the blocking zone, the springs of the heel-piece tend to bring the two free ends of the rods closer together and to hold them in the blocking zone.

To separate the heel from the heel-piece, the free ends of the rods of the heel-piece must move away from the associated blocking zones.

For a vertical release, it is necessary to overcome the force generated by the holding mechanisms in order to space the two free ends of the rods sufficiently apart and to extract them from the blocking zone until bringing them on the guiding zone.

For a lateral release, it is necessary to turn the heel-piece in order to move the free ends of the rods away from the blocking zones. In this case, the ends exit directly from the associated blocking zones, without passing through the guiding zones.

Certain known solutions disclosed in the previously mentioned documents provide relatively complex devices with:

- first mechanisms, usually first springs, acting on the rods to maintain a predetermined spacing of the ends thereof. When a vertical force exerted by the foot is greater than a vertical release threshold, the heel, i.e., the guiding paths, acts on the rods so as to cause a spacing of the ends of the rods that is sufficient to tilt them into the guiding zone, thereby releasing the boot from the heel-piece. If the vertical force is less than the vertical release threshold, the ends remain engaged in the blocking zones,
- second release mechanisms, usually second springs, different from the first springs, acting on the body of the heel-piece to maintain it in a predetermined angular position. When a torque about a vertical axis is exerted on the boot, this translates into a lateral force exerted by the foot on the heel-piece. The heel then acts on the rods so as to cause rotation of the body of the heel-piece about a vertical axis, against the force exerted by the first release mechanisms. As soon as the body reaches a specific angle, the rods disengage from the blocking zone 12, and the boot is released from the heel-piece. This angle is reached as soon as the lateral force is greater than a lateral release threshold. If the force is less than this threshold, the rods remain engaged in the blocking zones 12.

These solutions are complex. Furthermore, they are relatively heavy. However, lightness is critical to the performance of a binding. This is especially true in the case of ski touring, in which the user must lift his skis during an ascent.

The document EP 2 384 794 proposes a solution in which two springs urge the two rods for the vertical release. Furthermore, the same springs are part of the lateral release mechanism.

In this document, the main body supporting the rods is rotationally driven around a base during lateral release. The main body also supports a control body provided with a pin, extending vertically downward. The control body is constrained by springs housed in the main body. The pin cooperates with a V-shaped cam surface formed on the base. During lateral release, the body turns. The pin then engages the cam surface of the base, thereby causing a sliding displacement of the control body tending to constrain the springs. Thus, in order to turn the body, sufficient lateral force must be exerted to enable compression of the springs. The cam surface and the dimensioning of the springs define the lateral force to be exerted to obtain a predetermined rotation angle of the body. During lateral release, all of the force is transferred from the cam surface to the pin, thus making the system relatively fragile. During lateral release, only a single rod is biased to rotate the body. The lateral release is defined only by the cam surface of the base and the springs, independently of the rods and more particularly of their spacing. The rods are not biased into moving apart. Furthermore, the mechanism has a height space requirement because the vertical release mechanism and the lateral release mechanism are superposed vertically. Although the device has a reduced number of components as compared with similar heel-pieces, it still comprises a large number of components. In addition, the kinematics of the control body has a plurality of contact and friction zones which can interfere with proper operation of the release mechanisms through wear or jamming. The release values may then be corrupted.

However, winter sports, especially those practiced in the backcountry require very reliable equipment.

SUMMARY

The invention provides an improved heel-piece.

In particular, the invention provides a compact heel-piece.

The invention also provides a robust, or strong, heel-piece.

Furthermore, the invention provides a lighter heel-piece.

The present invention relates to a heel-piece for binding a boot on a gliding board, such heel-piece comprising:

- a frame adapted to be fixed to the gliding board and comprising a vertically extension;
- a body rotatably mounted about the vertical extension;
- at least two rods, supported by the body, extending on both sides of the vertical extension, the two rods each having a free end adapted to cooperate with a housing formed in the heel of the boot;
- a holding mechanism for maintaining a predetermined spacing between the free ends.

The vertical extension supports at least one contact zone, the latter being fixed in relation to the frame. Each rod cooperates with a respective predetermined portion of the contact zone, specific to each rod. The contact zone is arranged such that a rotation of the body about the extension, from a descent configuration, causes a relative spacing of the two ends that is greater than the predetermined spacing.

Thus, during lateral release, the body is rotationally driven, thereby also rotationally driving each of the two rods. Because each of the two rods is associated with a predetermined portion of the contact zone, they are then displaced so as to move away from one another. In the case of lateral release, for example during a fall, the force generated by the rotation of the heel-piece body is thus distributed on the two distinct predetermined portions of the contact zone, thereby improving the robustness/strength and reliability of the heel-piece.

When the relative spacing of the two rods is sufficient, the heel can be disengaged from the rods and removed from the heel-piece.

Optionally, the invention may have any of the following optional characteristics, taken alone or in combination:

- according to an embodiment, each rod and the portion of the contact zone associated therewith are located at the same vertical level;
- according to another embodiment, a portion of the frame extends through the body, the two rods being arranged on both sides of this portion extending through the body;
- according to another embodiment, the two rods and the holding mechanism form a unitary element.

Because the number of elements is reduced, the heel-piece is particularly robust and reliable. Moreover, the manufacturing and assembly costs are reduced. Furthermore, this characteristic makes it possible to significantly reduce the weight and space requirement of the heel-piece.

According to an embodiment, the body comprises an assembly mechanism for alternately affixing a unitary element having rods of various lengths to the body, while maintaining a predetermined identical distance between a free end of each rod and the axis about which the body turns.

According to another embodiment, the heel is configured such that the assembly mechanism can be deactivated when the body is positioned in at least one predetermined angular position in relation to the frame, the assembly mechanism allowing withdrawal of the unitary element only when they are deactivated, the heel-piece being configured so as to prevent the deactivation of the assembly mechanism when the body is not in the noted at least one predetermined angular position.

Thus, the unitary element can be inserted into and removed from the body particularly easily, and without the need of tools for adjustment or repair of the binding.

According to an embodiment, the unitary element forms a U-shaped fork.

According to another embodiment, the unitary element is inserted into a holding element attached on the body.

According to another embodiment, the contact zone is dimensioned such that when the body is positioned in at least one predetermined angular position in relation to the frame, each rod no longer cooperates with the contact zone; for example, the two rods are no longer in contact with the contact zone, or slightly cooperates with a portion of the contact zone to enable withdrawal of the rods out of the contact zone without tools, by manual action, including manual action exerted with only two fingers.

Thus, in an angular position of the body in relation to the contact zone affixed to the frame, the rods do not cooperate with the contact zone.

Thus, the rods are not always in tight contact with the contact zone and can be replaced easily, for example when worn or when the heel-piece user changes. After-sales service and rental of the gliding equipment are thus facilitated.

According to an embodiment, the heel-piece comprises a movable climbing aid so that, when positioned in a predetermined position, it cooperates with the rods in order to limit their relative spacing.

According to another embodiment, the heel-piece comprises a climbing aid provided on an upper portion of the frame, below which at least a portion of the body pivots.

Thus, when the climbing aid is set by the user in a given position, fixed in relation to the ski and independent of the rotatable body, the aid remains functional in the ascent. Often, the user, when moving on a slope, presses on the climbing aid along a transverse direction. If the climbing aid is assembled on the rotatable body, as is often the case in the prior art, then this transverse support causes rotation of the body and of the aid which stops being functional. With the proposed construction, the climbing aid, by being positioned in relation to the ski, remains functional even if a lateral force is exerted on the aid. Similarly, if the body is rotated unintentionally, for example under the effect of contact with the boot, the other ski, or a block of snow, then the body does not drive the aid.

According to an embodiment, the upper portion of the frame, on which the climbing aid is provided, forms the extension of the vertical extension.

The invention also relates to a system for binding a boot on a gliding board comprising a toe-piece configured to affix the front of the boot to the gliding board, as well as a heel-piece according to the invention.

In addition, the invention relates to a gliding board comprising a heel-piece according to the invention.

BRIEF DESCRIPTION OF DRAWINGS

Other characteristics and advantages of the invention will become apparent from the following detailed description, provided by way of non-limiting examples, with reference to the annexed drawings, in which:

FIGS. 12 to 14 are perspective views in a descent configuration, a first ascent configuration and a second ascent configuration, respectively.

FIG. 15 is a cross-sectional view, along the line XV-XV of FIG. 16, of the heel-piece shown in FIG. 12.

FIGS. 16 and 17 are cross-sectional views, along the line XVI-XVI of FIG. 15, of the heel-piece, each with a fork having different characteristics.

FIG. 18 is a perspective view of the top of the heel-piece shown in FIG. 12, the climbing aid of which is disassembled to show the rotational indexing mechanism.

DETAILED DESCRIPTION

The following description makes use of terms such as "horizontal", "vertical", "longitudinal", "transverse", "upper", "lower", "top", "bottom", "front", "rear". These terms must be considered as relative terms in relation to the normal position that the heel-piece occupies on a ski, and the normal advance direction of the ski. For example, "longitudinal" means in relation to the longitudinal axis of the ski.

Figure 1:
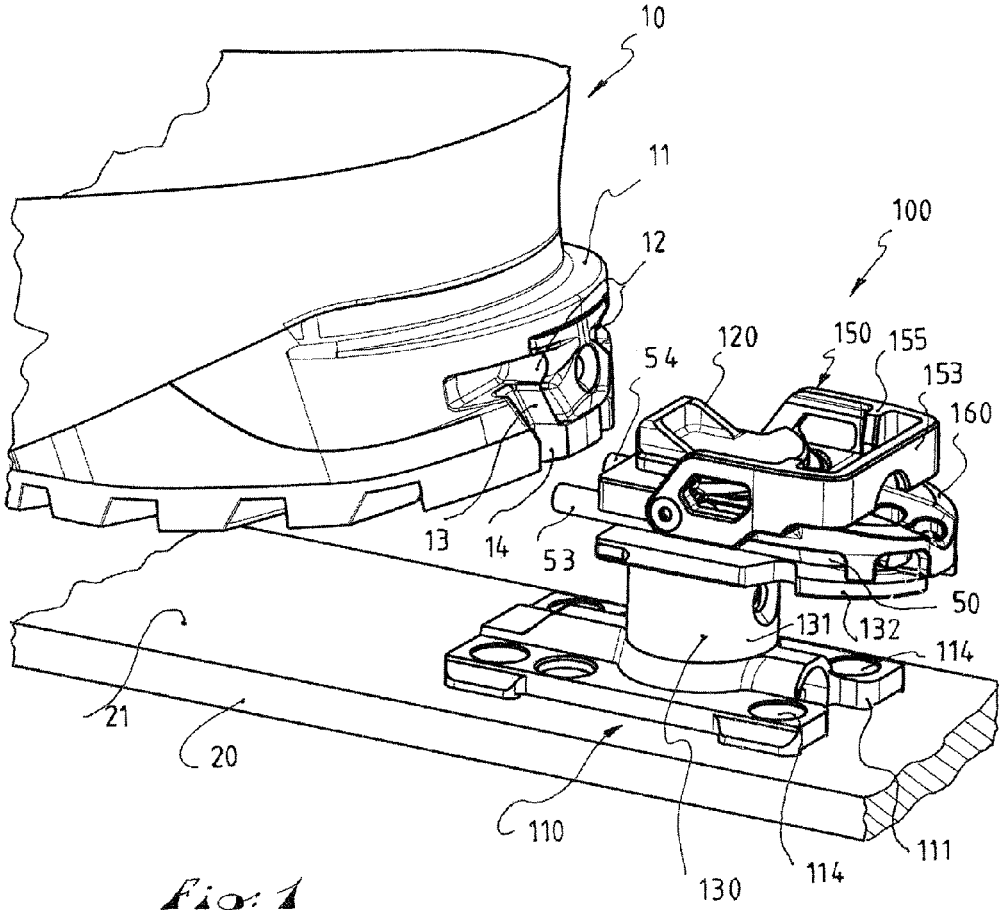
FIG. 1 is a perspective side and rear view of a heel-piece according to a first embodiment of the invention, the heel of a boot also being shown. In this figure, the heel-piece is in a configuration, so-called "descent configuration", in which it is ready to be attached to the heel.
Figure 2:
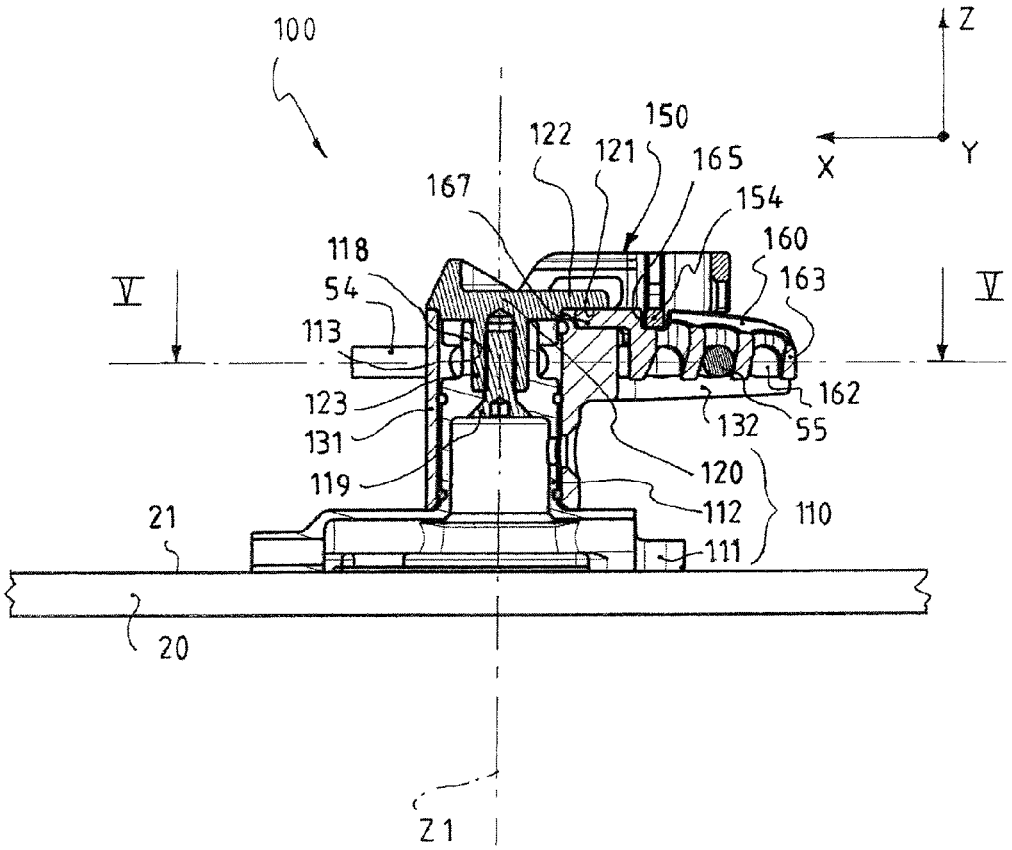
FIG. 2 is a cross-sectional view along the line II-II of FIG. 5 of the heel-piece shown in FIG. 1.

FIG. 2 illustrates the main directions. The longitudinal direction corresponds to the axis X. The transverse direction corresponds to the axis Y. The vertical direction corresponds to the axis Z.

A first non-limiting embodiment is described in detail, below, with reference to FIGS. 1 to 11.

The heel-piece 100 is shown fixed to the upper surface 21 of a gliding board 20 of a ski.

The heel-piece 100 comprises a frame 110 having a base 111 configured to be fixed to the gliding board 20, in this example by screws extending through openings 114. Alternatively, the base can be assembled to the ski by a sliding connection, along a longitudinal direction in relation to the ski. This makes it possible to adjust the longitudinal position of the heel-piece in order to adjust the binding in relation to the boot size or for a "recoil" function (maintaining contact between the heel-piece and the boot when the ski bends, i.e., flexes, in the descent configuration). In the first case, a mechanism is provided for blocking the longitudinal displacement of the frame to the desired position. In the second case, a mechanism is provided for compensating for the longitudinal displacement of the frame to maintain it at a desired position, even when the ski bends. In the end, the base is considered as fixed to the gliding board because, in use, its position on the ski is subject to little or no variation.

The frame 110 also comprises a vertical extension 112 affixed to the base 111, and which extends upward therefrom along a vertical direction.

The heel-piece 100 also comprises a body 130 rotatably mounted on the vertical extension 112. To guide the body 130 rotationally on the frame 110, the body 130 comprises a generally cylindrical sleeve 131 having a bore within which at least a portion of the vertical extension 112 is inserted. Thus, at least a portion of the vertical extension 112 is shaped to cooperate with the sleeve 131 so as to guide the latter rotationally about an axis Z1. In this non-limiting example, the axis of rotation corresponds to the vertical when the ski is positioned flat.

The frame 110 also includes a stop 120 affixed to the vertical extension 112. In this example, the stop is fixed by a screw 119 onto the upper end of the vertical extension 112. The stop is positioned above the sleeve 131 and has at least one radial dimension greater than the bore of the sleeve.

Thus, the stop 120 prevents or limits sliding of the body 130 along the axis of rotation Z1 in a first direction, that is to say upward in the drawing figures.

As illustrated in FIG. 2, the vertical extension 112 and the base 111 form a unitary element, that is, a one-piece element. The vertical extension 112 comprises a housing 113 at its upper end, configured to partially receive a vertical portion 123 of the stop 120, the vertical portion 123 extending downward. The cooperation of the inner and outer shapes of the housing 113 and of the vertical portion 123, respectively, ensures good relative positioning between these elements.

In a non-illustrated embodiment, it is the vertical portion 123 of the stop 120 that has an inner housing configured to receive the end of the vertical extension 112.

The frame 110, comprised in particular of the base 111, the vertical extension 112, and the stop 120, thus forms a bearing for rotationally guiding the body 130.

The body 130 is configured to support two rods 51, 52, each having a free end 53, 54 designed to cooperate with a heel 11 of a boot 10. In a known manner, the heel comprises a housing comprised of engagement zones 14, guiding zones 13, and blocking zones 12 as described above. During engagement of the heel-piece, the free ends 53, 54 penetrate into this housing of the heel.

When the heel-piece is in the descent configuration, the body 130 is positioned in relation to the frame, so that the free ends 53, 54 are capable of cooperating with the housing of the heel of the boot. The body 130 and the rods 51, 52 are substantially aligned with the longitudinal axis of the gliding board. The two free ends 53, 54 project from the body 130 toward the front of the ski. The two free ends 53, 54 are arranged substantially symmetrically in relation to the longitudinal axis of the ski. The relative positioning of the rods 53, 54 in the descent configuration will later be designated as a "neutral position".

The body 130 comprises a lower flange 133 and an upper flange 134 in the upper portion of the sleeve 131. The flanges each extend transversely on both sides of the axis of rotation Z1 of the body. Each flange then projects with respect to the cylindrical outer envelope of the sleeve 131. The two flanges 133, 134 are vertically spaced apart by a distance slightly greater than the diameter of the rods 51, 52. The lower flange 133 is extended rearward by a longitudinal extension 132 with reference to a position of the body when the heel-piece is in the descent configuration. Thus, in the descent configuration, the two rods 51, 52, when in place on the body, are simply supported on the lower flange 133 and on its longitudinal extension 132, and their free ends 53, 54 project forward from the body 130. The vertical displacement of the two rods is furthermore limited by the lower 133 and upper 134 flanges of the body. In this example, the two flanges 133, 134 and the sleeve barrel 131 constitute a housing for each of the rods 51, 52.

Each free end 53, 54 of the rods 51, 52 thus forms a projection in relation to the body 130 and to the remainder of the heel-piece 100, as illustrated in the drawing figures.

The rods 51, 52 extend horizontally and are arranged on both sides of the vertical extension 112.

The two rods 51, 52 are connected to one another by a junction portion 55 so as to form a fork 50. The fork 50 is generally U-shaped. The two arms of the U-shape thus form the two rods 51, 52, and the connection between the arms of the U-shape forms the junction portion 55. The free ends of the arms correspond to the free ends 53, 54. The fork 50 has an axis of symmetry 56 passing equidistantly between the rods 51, 52. The junction portion 55 serves as a holding mechanism for the free ends 53, 54. Thus, this junction portion 55 provides elasticity to the fork that tends to return the rods to the neutral position as soon as the rods are no longer biased. The fork acts like a spring or a spring clip, the arms of which are energized to return to a stable neutral position.

In the neutral position, the fork 50 has a predetermined relative spacing E1 between the free ends 53, 54 of the rods 51, 52. See FIG. 5.

A lateral force, exceeding a threshold, makes it possible to elastically deform the arms of the fork 50 and to space the free ends 53, 54 beyond the neutral position. The fork 50 is dimensioned to exert a return force that tends to return the free ends 53, 54 to the predetermined spacing E1 of the neutral position as soon as the rods are spaced from the neutral position.

In this example, the junction portion 55 rests on the longitudinal extension 132.

The fork 50 can be inserted into the body 130 by a sliding movement perpendicular to the axis of rotation Z1 of the body 130. The fork 50 is positioned in the housing formed by the two flanges 133, 134.

The body 130 comprises an opening 135 associated with each rod 51, 52 in the upper portion of the sleeve 131. Each opening 135 is configured such that when the rods 51, 52 are inserted into the body 130, a portion of the rods 51, 52 projects inward of the sleeve 131, beyond the inner wall of the latter. In the illustrated embodiment, the openings 135 are two in number and are located on both sides of the vertical axis of the body. An opening 135 appears in FIG. 3.

The vertical extension 112 further comprises at least one contact zone 115, positioned opposite the openings 135. The heel-piece 100 is configured so that the contact zone 115 is located at a same height level as the rods 51, 52 when the heel-piece is assembled. Furthermore, in certain angular positions of the body 130 in relation to the frame 110, each of the rods 51, 52 is in contact, directly or indirectly, with a portion of the contact zone 115 associated therewith.

The rotation of the body 130 about the axis Z1 rotationally drives the rods 51, 52. The contact zone 115 is also fixed in relation to the gliding board 20 by virtue of being affixed to the frame 110 fixed to the ski. Consequently, each rod 51, 52 is biased by a portion of the contact zone 115 associated therewith.

Within the meaning of the invention, a contact zone 115 is defined by one or more elements configured to be in contact with an associated rod 51, 52. The position of the relative contact changes as a function of the rotation of the body 130. The contact zone then corresponds to all of the contact surfaces between the element(s) and the associated rod.

A contact zone can therefore be comprised of a plurality of surfaces belonging to a plurality of elements. It can be obtained by a portion of a single element.

According to the invention, each rod cooperates directly or indirectly with a predetermined portion of a contact zone. Thus, a first rod 51 cooperates with a first portion of the contact zone 115 and the second rod 52 cooperates with a second portion, separate from the first portion, of the contact zone 115. Each rod can cooperate with a contact zone that is specific thereto. There are then two distinct contact zones, one for each rod. Alternatively, there may be a single common contact zone, but one comprising separate portions, each being adapted to be in contact with a predetermined rod.

In the example illustrated, the contact zone 115 is carried by the vertical extension 112 forming a unitary element with the base 111. According to a non-illustrated embodiment, it is carried by an element fixedly attached on the base 111. For example, it may be carried by an outer surface of the fixing portion of the stop 120.

The contact zone 115 can be made of a portion of a constituent element, for example an upper portion of the vertical extension 112.

The contact zone 115 may also be provided on one or more elements attached on a constituent portion of the frame, for example an upper portion of the vertical extension 112. The attached element may be a metal blade, a pre-formed ring, pins, etc.

Thus, during operation, the release mechanism biases the attached element and not the constituent element of the frame. Consequently, the attached element wears out and reduces or eliminates the wear on the vertical extension. It is then easy to replace the attached element once worn. This facilitates the after-sales service and increases the useful life of the heel-piece.

In the exemplary embodiment illustrated in FIGS. 5, 7, 9, and 11, the contact zone is formed by a plurality of pins 116 arranged in housings carried by the vertical extension 112. A contact zone 115 is assigned to each rod and is defined by two pins 116, so that a pin forms a linear support with an associated rod 51, 52 for a particular angular configuration. Thus, during rotation of the body 130, the rods 51, 52 move apart by taking support on the pins 116 rather than on the vertical extension 112, thereby reducing the wear on the latter. Thus, if worn out, the pins 116 can be readily replaced without changing the remainder of the heel-piece 100. The pins 116 are made, for example, of hardened metal with a 60 HRC hardness.

In the case in which the contact zone is defined by a cylinder or a pin, for a predetermined angular position, the contact between the rod and the contact zone corresponds to a first generating line of the cylinder. When the body rotates, the contact changes and corresponds to a second generating line of the cylinder angularly offset in relation to the first generating line. The contact zone therefore corresponds to all of the generating lines, namely an angular portion of the outer cylindrical surface.

Figure 5:
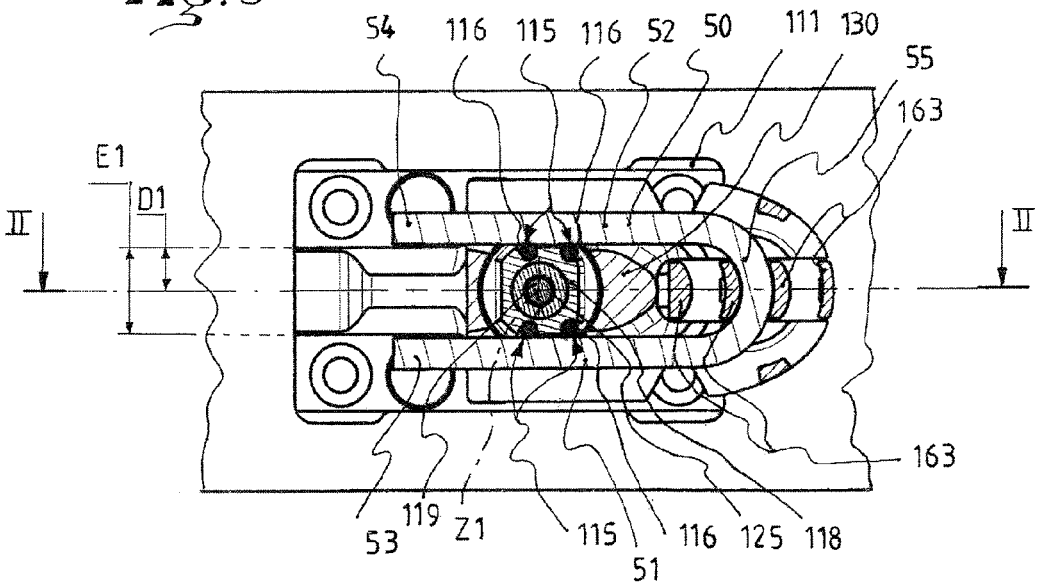
FIG. 5 is a view along a cross-section, along the line V-V of FIG. 2, of the heel-piece shown in FIG. 1.
Figure 9:
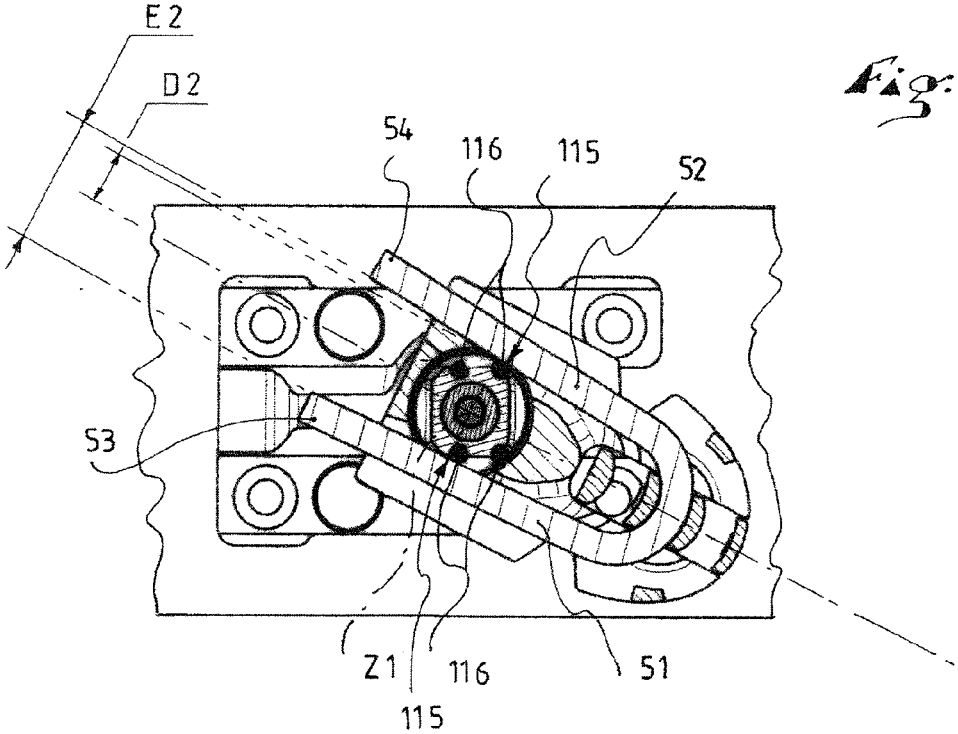

In the illustrated example, a contact zone assigned to a rod is defined by two pins 116. In the neutral position, a rod 51, 52 is in contact with the two pins 116, as shown in FIG. 5. When the body rotates in one direction, the rod is then in contact with only one of the two pins 116, as shown in FIG. 9. If the body rotates in the other direction, the rod comes into contact with the other one of the two pins 116. The contact zone 115 is thus defined here, either by a first pin (FIG. 9) or by a second pin (not shown), or by the two pins (FIG. 5). The contact zone 115 is comprised of a portion of the outer envelope of the first pin and of a portion of the outer envelope of the second pin.

To improve the robustness, or strength, of the heel-piece, the contact zone 115 can be covered with a coating for reducing the frictional wear between the rods 51, 52 and the contact zone 115.

Figure 4:
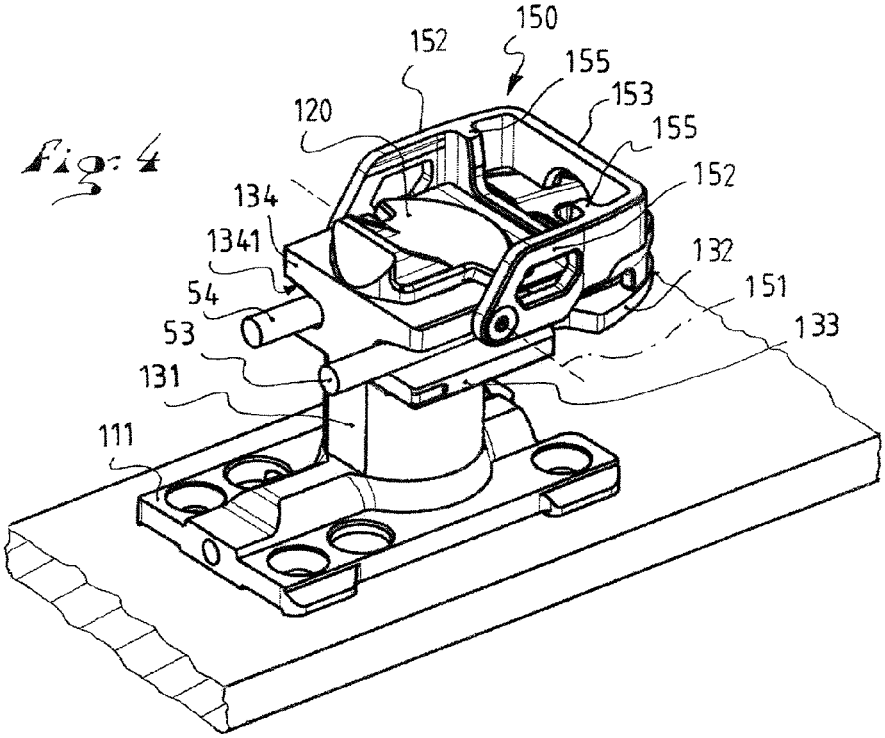
FIG. 4 is a perspective view of the top and front of the heel piece shown in FIG. 1.

The contact zone 115 is dimensioned such that:

when the body 130 is in an angular position corresponding to the descent configuration, the contact zone 115 performs little or no action on the associated rods 51, 52. According to one embodiment, the spacing E1 between the free ends 53, 54 is dimensioned so that the rods cannot be easily extracted from the housing of the heel 11 without a pulling force from the user. This configuration is illustrated in FIGS. 2, 4, and 5, and the spacing E1 is referenced in FIG. 5;

when the body 130 rotates around the frame 110, in either direction, from the descent configuration, the contact zone 115 acts on the associated rods 51, 52 so as to space the free ends 53, 54 apart. To space these free ends apart, a lateral force must be exerted on the rods to compensate for the elastic return force exerted by the junction portion 55. Consequently, to rotate the body about the vertical extension 112 by a predetermined angle, a predetermined force must be exerted. From a certain angle of rotation of the body, referred to as the release angle, the free ends 53, 54 exit the housing of the heel, along a substantially horizontal direction, thereby separating the rear of the boot from the heel-piece. Thus, to obtain the lateral release of the boot, it is necessary to achieve this release angle and, therefore, to exert a lateral release threshold force on the body 130 via the rods 51, 52. The shape of the contact zone defines the force curve to be exerted on the body to obtain a predetermined angle of rotation of the body.

The rotation of the body 130 is obtained during the lateral release resulting from a torque exerted on the boot about a vertical axis located substantially at the front of the boot. This torque is transposed by a substantially lateral force as mentioned above. Because the heel rotates about a vertical axis arranged at the front (in the area of the toe-piece of the binding), the arcuate path further promotes the withdrawal of the free ends 53, 54 from the heel housing.

For a lateral release, the removal of the free ends 53, 54 from the heel housing is carried out on a substantially horizontal plane, contrary to a vertical release in which the withdrawal is carried out along a substantially vertical plane.

This rotation also causes the spacing apart of the free ends 53, 54, thereby facilitating the extraction of the heel from of the rods 51, 52 along horizontal and vertical direction.

Figure 8:
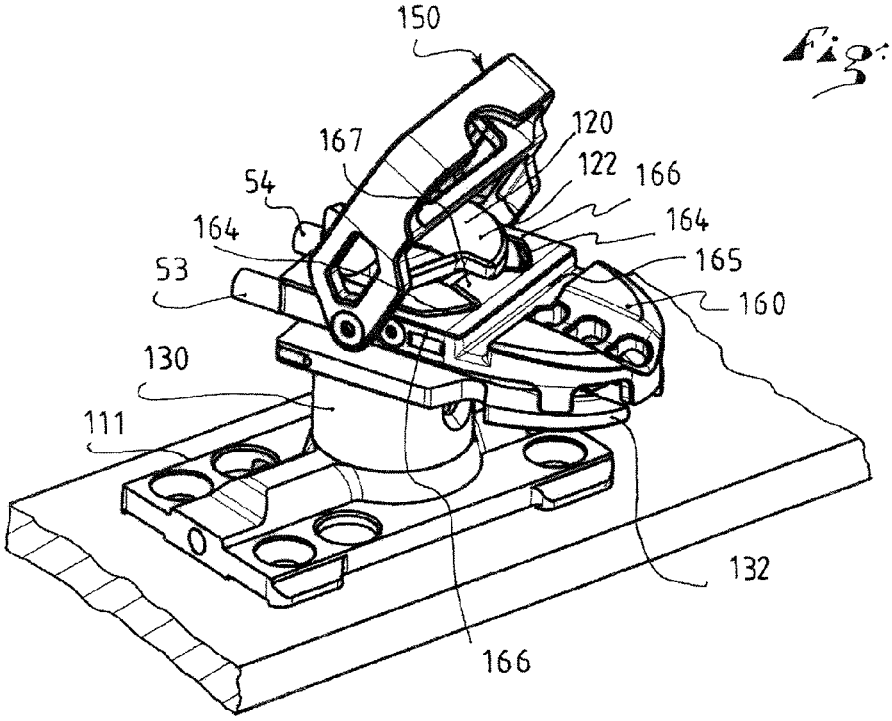
FIGS. 8 and 9 are perspective and cross-sectional views, along the line V-V of FIG. 2, of the heel-piece shown in a configuration, so-called "lateral release configuration", in which the body is rotated.

This configuration, so-called "lateral release configuration", is illustrated in FIGS. 8 and 9. The ends 53, 54 move apart until reaching a spacing E2, with E2>E1. The spacing E2 is illustrated in FIG. 9.

In this release configuration, with the body 130 rotated, the distance D2 between the axis of rotation Z1 of the body 130 and the point of contact of a rod 51, 52 with the associated contact zone 115 becomes greater than the distance D1 between these same references in the descent configuration. The distances D1 and D2 are shown in FIGS. 5 and 9, respectively.

This lateral release occurs when a torque is exerted on the body 130. This torque can be unintentional, as is the case when a user falls while having his/her heel 11 fixed to the heel-piece 100. This torque can also be intentional, as is the case when the user does not wish to fix the heel 11 to the heel-piece 100, but wishes to keep it free. A pivoting of the body 130 about the axis of the frame 110 then makes it possible to rotate the rods 51, 52 so that their ends are no longer opposite the heel 11.

Thus, it is the energy of the U-shape which is used to allow or prevent the vertical release, but also to allow or prevent the lateral release. The contact zone located between the two rods of the U-shape oppose the rotation of the latter, thereby generating a torque proportional to the stiffness upon spacing of the rods 51, 52 of the U-shape.

This minimalist structure of the holding mechanism 55 and of the rods 51, 52 increases the reliability of the heel-piece.

Furthermore, this design avoids possible perturbation or deviation, over time, of the value of the release thresholds.

In a particular non-limiting embodiment, the contact zone 115 is designed so that the maximum spacing of the ends 53, 54 of the rods 51, 52 is obtained when the body 130 has rotated by an angle between 30° and 70°.

Thus, this construction enables an efficient lateral release while distributing the return force of the rods over at least two surfaces, thereby contributing efficiently to the robustness and reliability of the heel-piece 100.

The contact zone 115 is also dimensioned so as to ensure elastic return of the body 130 and the rods 51, 52 to the descent configuration, as soon as the body pivots at least up to the lateral release angle. Thus, when the body rotates by a return angle less than the release angle, the latter is subject to a torque that tends to return it to its neutral position when it is no longer biased. The contact zone 115 may also enable an elastic return for a return angle greater than the release angle. The limit return angle can be between 30° and 90°.

Furthermore, the kinematics of the lateral release is minimalist and is based on simple elements to manufacture, which are robust and limited in number, thereby increasing the reliability and lightness of the release mechanism.

The fork 50 is also responsible for the vertical release. Indeed, in the case of substantial vertical force, for example during a forward fall, corresponding to an upward vertical force exerted by the heel 11, the boot separates from the rods 51, 52. Because, in its inlet, the blocking zone 12 has a slope that is inclined outward toward the bottom of the heel 11, the free ends 53, 54 of the rods 51, 52 slide over this slope by moving apart and they exit the blocking zone 12. The free ends 53, 54 then escape from the housing of the heel 11. The heel 11 is released from the heel-piece 100. The rods 51, 52 are spaced apart during exit from the blocking zone 12. This spacing of the rods is carried out against the elastic force exerted by the junction portion 55.

Figure 3:
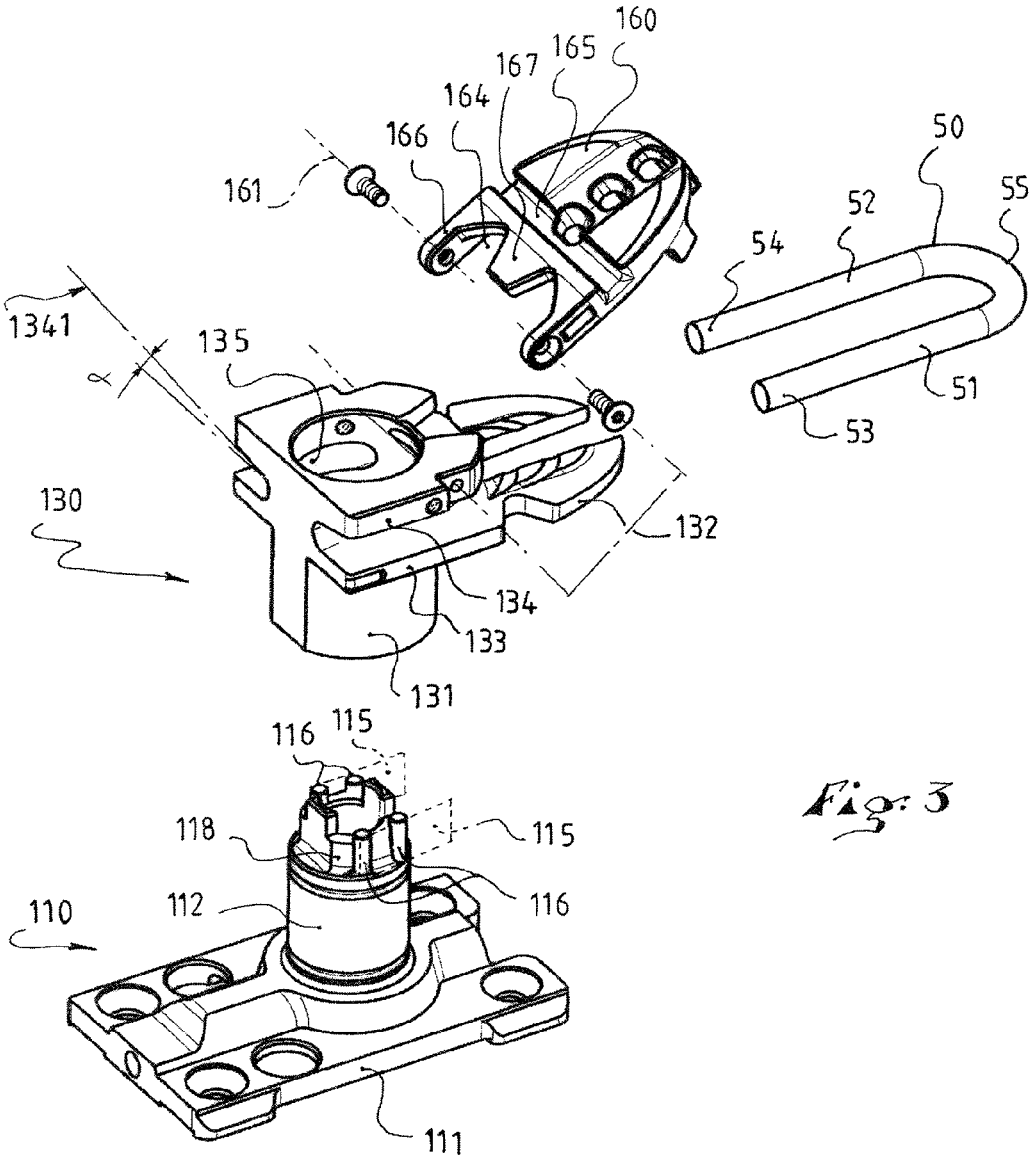
FIG. 3 is an exploded perspective view of the top of elements of the heel-piece shown in FIG. 1.

To improve the vertical release, each upper flange 134 of the body 130 includes a lower surface 1341 (see FIG. 4) inclined in relation to a horizontal plane, by an angle $\alpha$, as seen in FIG. 3. This inclination of the lower surface 1341, combined with the slope of the blocking zone 12, helps to facilitate the spacing apart of the free ends 53, 54 of the rods 51, 52. Indeed, an upward vertical force of the rods 51, 52 on these inclined lower surfaces 1341 generates a transverse component in reaction, tending to space the free ends 53, 54 apart.

Therefore, it is indeed the fork 50 that determines both the lateral release threshold and the vertical release threshold.

The fork 50 comprising the rods 51, 52 and the junction portion 55 form a unitary element, which increases the robustness of the heel-piece 100. In an exemplary embodiment, the fork 50 is made of metal, for example high yield strength metal.

According to an embodiment not shown, at least the portions of the rods 51, 52 adapted to cooperate with the contact zone 115 are covered with a coating or a layer for reducing frictional wear.

In the first embodiment illustrated in FIGS. 1 to 11, the heel-piece 100 comprises a climbing aid 150 configured to serve as a support to the skier's heel during the ascent. In a known manner, a climbing aid 150 is assembled so as to pivot in relation to the body 130. The climbing aid 150 forms a generally U-shaped profile and rotates about an axis of rotation 151 passing through the end of the two arms 152 of the profile.

In the example, the axis of rotation 151 of this articulation is substantially horizontal. It is defined in relation to the body 130 and extends transversely with reference to the position of the body when the heel-piece is in the descent configuration. The two arms 152, 152 extend from the hinge axis 151, on both sides of the longitudinal axis of the body 130. A crosspiece 153 connects the ends of the two arms 152, 152 opposite the hinge axis. In the descent configuration, the climbing aid can tilt rearward against a stop to come into the "deactivated" position, or forward against another stop to come into the so-called "activated" position. The crosspiece 153 and/or the arms 152, 152 then serve as a support zone to the heel 11 in the activated position.

In the first, so-called "deactivated" or "retracted" position, the climbing aid is positioned so as not to hinder the vertical downward displacement of the heel of the user. The user can then fix his/her heel to the heel-piece 100 if the latter is configured for the descent.

In a ski touring configuration, the user only fixes the front of the boot 10 to a boot-retaining device called a "toe-piece" and releases the heel from the heel-piece. The toe-piece is designed to allow vertical mobility of the heel. The ascent configuration is used to move on flat terrain or on slopes. To facilitate the thrust of the skier, the device provides various support heights for the heel. For a rather flat terrain, the support height must be near the upper surface of the ski. Conversely, the greater the slope, the more preferable is it to have support height under the heel. U.S. Patent Application Publication No. 2014/0110919-A1, the disclosure of which is hereby incorporated by reference thereto in its entirety, describes and illustrates an exemplary toe-piece.

Figure 10:
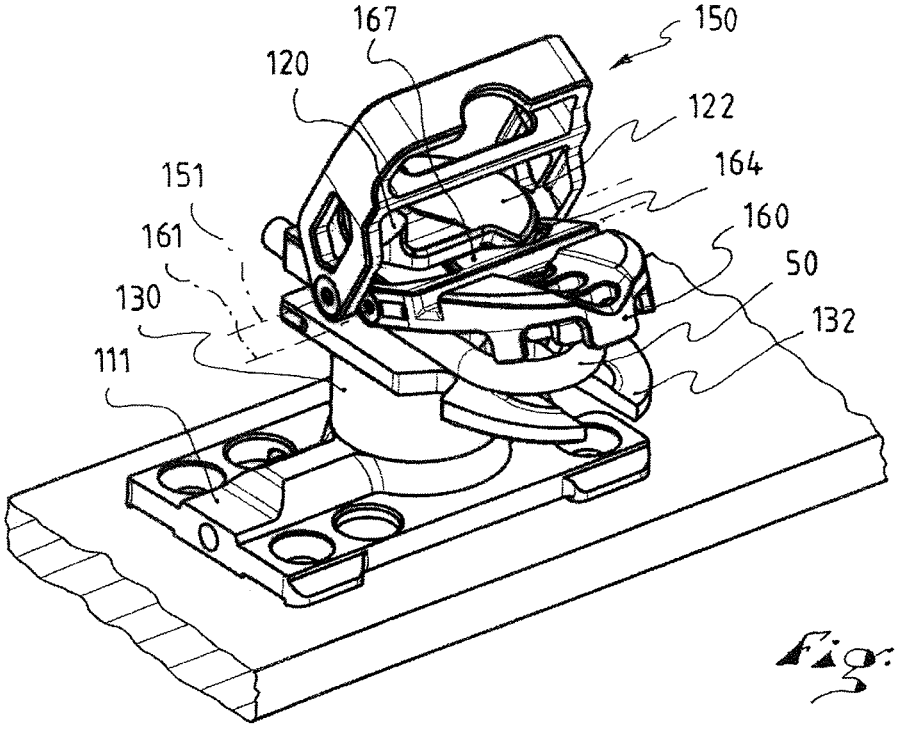
FIGS. 10 and 11 are perspective and cross-sectional views, along the line V-V of FIG. 2, of the heel-piece illustrated in a configuration, so called "withdrawal configuration" of the fork.
Figure 11:
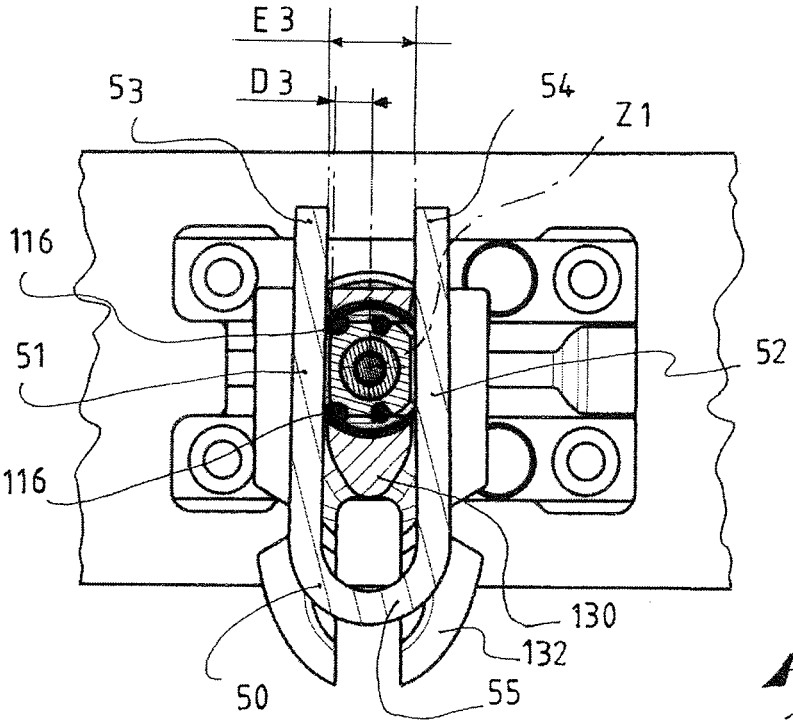

By rotating the body 130 by 90°, the free ends 53, 54 are withdrawn from cooperation with the housing of the heel. The heel can then be supported directly on the upper surface of the ski or on the base 111. This configuration is illustrated in FIGS. 10 and 11. It is used for flat terrain.

For sloping terrain, the body 130 is maintained in a neutral position, in which the rods are capable of cooperating with the housing of the heel. However, the climbing aid is added.

Figure 6:
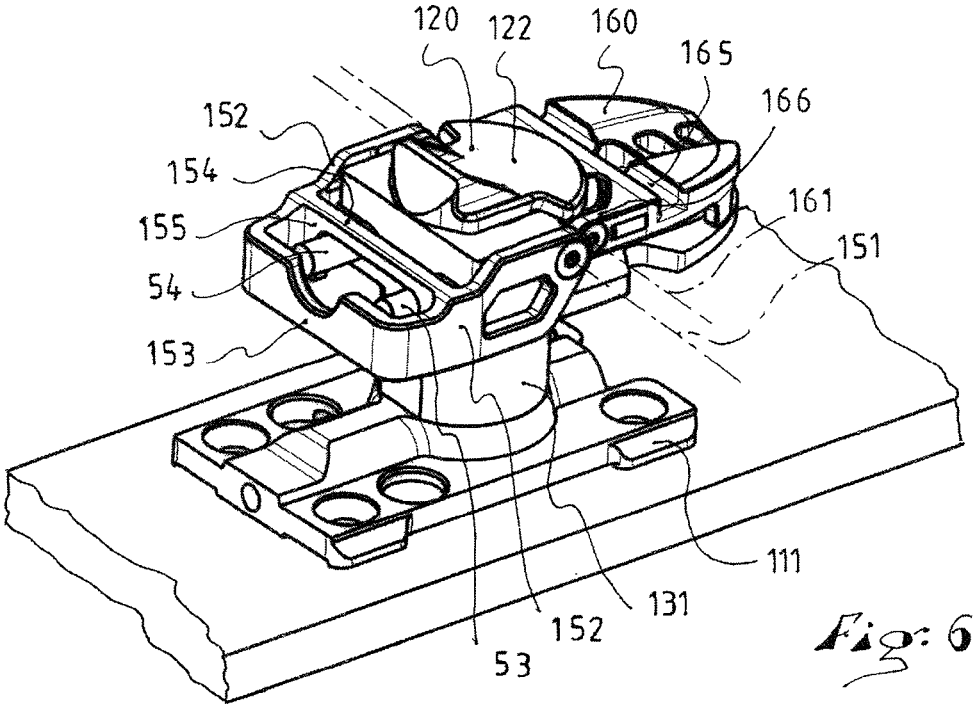
FIGS. 6 and 7 are perspective and cross-sectional views, respectively, along the line VV of FIG. 2, of the heel-piece shown in a configuration, so called "ascent configuration", in which the climbing aid is activated.
Figure 7:
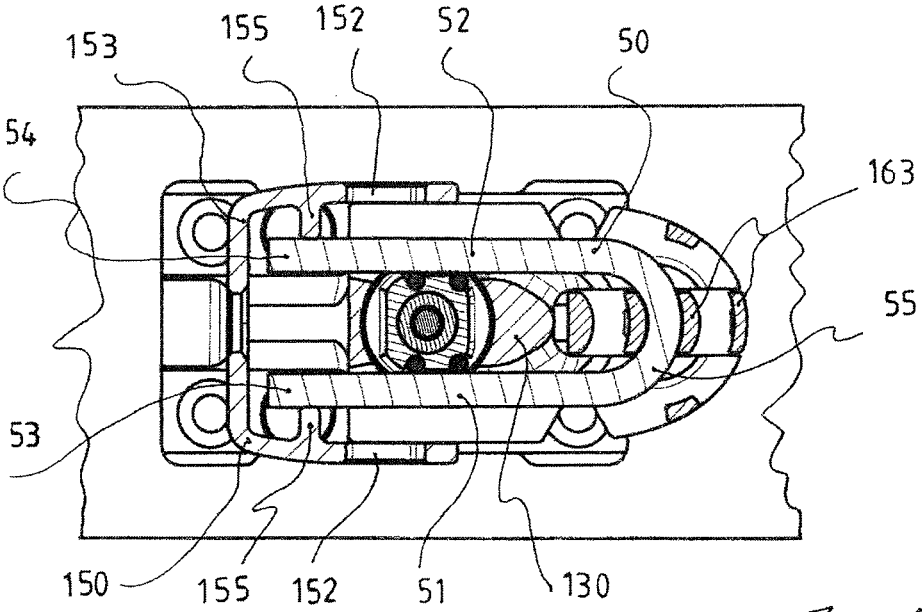

In the second position, that is, the so-called "activated" position, the climbing aid 150 is designed to limit the vertical downward displacement of the heel 11. This position is illustrated in FIGS. 6 and 7. In this position, the climbing aid 150 prevents the heel from reaching the base 111 or the gliding board 20, and assists the user during an ascent phase on a steep slope. The climbing aid 150 can be manipulated by the user, either manually or using of his/her pole.

In FIG. 8, the climbing aid 150 is illustrated in an intermediate position.

Advantageously, the climbing aid 150 is configured to cooperate, in the activated position, with the rods 51, 52 so as to prevent their spacing from being sufficient to enable the body 130 to rotate about the vertical extension 112.

In the illustrated embodiment, two stop portions 155 carried by the arm 152 of the climbing aid 150 are positioned in the vicinity of each respective one of the rods 51, 52, on the outside with respect to the axis of rotation of the body 130. This proximity enables direct contact between the stop portions 155 and the rods 51, 52. The spacing of the rods 51, 52 is then limited, thereby blocking the rotation of the body 130. Any angular displacement of the body 130 is then prevented or substantially reduced.

This characteristic makes it possible to prevent ill-timed rotation of the body or of the climbing aid while the climbing aid 150 is activated, and without adding complexity, weight, or bulk to the heel-piece 100. Thus, this configuration is secured by keeping the climbing aid operational.

In the embodiments illustrated in FIGS. 6 and 7, the stop portions 155 are carried by an additional crosspiece 154 extending from one arm 152 to the other of the aid. This additional crosspiece 154 is supported on the rods 51, 52, thereby limiting rotation of the climbing aid about its hinge axis 151. The user can then easily set up the climbing aid in this stable indexed position. The heel pressure force is thus taken up by the rods 51, 52.

The body 130 comprises an assembly mechanism for alternately affixing forks 50 having different rod lengths to the body 130, while maintaining an identical predetermined distance between the free end 53, 54 of each rod 51, 52 and the axis Z1 about which the body 130 rotates.

Thus, a fork 50 can be inserted into and removed from the body 130 in a particularly simple manner, and without the need for tooling.

A first fork may be replaced by a second fork whose properties, in particular the stiffness of the spacing between the two rods 51, 52, are different from those of the first fork. The release threshold can thus be adjusted as a function of the user.

According to a particular embodiment, the assembly mechanism can be deactivated when the body 130 has a predetermined angular position in relation to the frame 110, typically a 90° angle with respect to the descent configuration. This predetermined angular position is referred to as an angular unlocking position. The assembly mechanism allows withdrawal of the fork 50 only when they are deactivated. The heel-piece 100 is configured to prevent deactivation of the assembly mechanism when the body 130 is not in the angular unlocking position.

In the embodiment illustrated in FIGS. 1 to 11, the assembly mechanism comprises a locking cap 160 pivotally hinged on the body 130, about a substantially horizontal axis 161. The locking cap 160 has two arms 166 extending from the hinge axis 161 to a holding cover 168 of the fork. A passage opening 164 is thus created between the arms. A locking lug 167, or projection, extends longitudinally from the holding cover 168 to the inside of the passage opening 164. The lower surface of the cover 168 is arranged opposite the fork 50 and thus prevents the displacement of the fork 50. For example, the lower surface of the cover has notches 162 defined by walls 163 each forming an axial stop. These axial stops are shaped so that the fork 50, once inserted in a notch 162, can no longer slide horizontally.

Thus, the locking cap 160 is designed to:

- block the fork 50 when the cap is folded over the longitudinal extension 132 of the body 130. This position is illustrated in FIGS. 2, 5, 7 and 9;
- allow withdrawal of the fork 50 when the cap is away from the longitudinal extension 132 of the body 130. This position is illustrated in FIGS. 10 and 11.

The frame 110 includes a locking stop 121 arranged so as to:

- allow pivotal spacing of the locking cap 160 in relation to the body 130 when the latter is in the angular unlocking position;
- prevent this spacing when the body 130 is not in the angular unlocking position.

The locking stop 121 appears clearly in FIG. 2. In this embodiment, it is carried by the stop 120. It is positioned vertically at right angles with the locking cap 160 when the body 130 is not in the angular locking position.

The stop 120 has a portion 122 extending horizontally rearward, and a lower surface of which forms the locking stop 121. The horizontal portion 122 is dimensioned so that, when the body 130 is in the angular unlocking position, the locking stop 121 is not opposite the locking lug 167 of the cap. In this case, the locking cap 160 is pivotable about its axis 161. The portion 122 of the stop then passes through the passage opening 164. The user can lift the locking cap 160 and move it away from the longitudinal extension 132 of the body 130. The fork 50 can then be removed.

Conversely, when the body 130 is no longer in the angular unlocking position, then the locking stop 121 is positioned opposite the locking lug 167. In this case, the rotation of the locking cap is blocked. The fork 50 is continuously held in position.

Thus, the heel-piece 100 makes it possible to unlock the locking cap 160 by simple rotation of the body 130, which may be exerted manually, and thus to ensure proper locking of the cover 160 in the other positions. This solution is particularly robust, reliable, and makes it possible to maintain a limited weight.

The stiffness of the spacing between the free ends 53, 54 of the rods 51, 52 depends in particular on the length of the rods, that is to say the distance between each free end of a rod 51, 52 and the junction portion 55. Thus, a fork 50 having shorter rods has a higher stiffness upon spacing of its ends 53, 54, than a fork 50 having longer rods.

In a particular embodiment, the distance between the free ends 53, 54 of the rods 51, 52 and the axis Z1 about which the body 130 rotates should be the same, irrespective of the length of the fork 50, in order to always cooperate with the housing made in the heel 11.

So that this distance remains the same irrespective of the length of the fork 50, the heel-piece 100 makes it possible to position the junction portion 55 by moving it away from the axis of rotation of the body 130.

To this end, the longitudinal extension 132 supporting the junction portion 55 and/or, as is the case in the example illustrated, the lower surface of the cover has a plurality of notches 162, each corresponding to a position of the fork 50 in relation to the axis of rotation Z1 of the body 130. In FIGS. 2 and 5, for example, it is apparent that the locking cap 160 has three notches 162, the illustrated fork 50 being dimensioned to be housed in the intermediate notch.

Alternatively to or in combination with the change in length of the fork 50 to vary the threshold value, it is also possible to provide forks having various cross-sections. The larger the cross-section of the fork is, the greater the stiffness upon spacing of its ends 53, 54 and the higher the release threshold will be.

Thus, the invention enables a particularly fast, simple adaptation of the threshold of the releases of the heel-piece 100, and without the need of tools, to release the heel 11. This is particularly advantageous when the equipment is rented since the release threshold can easily be adapted to the weight or the experience level of the client who will use the heel-piece 100.

Advantageously, the locking cap 160 includes a housing 165 for the additional crosspiece 154 of the climbing aid, which makes it possible to reduce the space requirement.

This construction enables a common element, namely the fork 50, to ensure the vertical release and lateral release.

To address the need for security, the lateral release value is not the same as the vertical release value. Thus, in a particular embodiment, the vertical release value is substantially four times greater than the lateral release value.

To adjust the vertical release to horizontal release ratio, one can modify the shape and/or dimensions of the fork, for example the cross-section of the rods 51, 52 and/or of the junction portion 55.

Furthermore, the vertical release to horizontal release ratio may be adjusted by modifying the contact zone 115.

Another way to modify this ratio involves changing the inclination of the lower surface 1341 of the upper flange 134. The greater the angle α, the more facilitated is the lateral release.

One can also modify the slope of the blocking zone 12 of the boot.

Alternatively or in combination, the vertical release to horizontal release ratio may be adjusted by dimensioning the contact zone 115 so that it biases the rods 51, 52 when they are in a neutral position, in the descent configuration. For example, when the heel-piece is in its descent configuration, the contact zone causes the initial spacing E1 of the free ends 53, 54 so as to facilitate the vertical release.

The dimensioning of a fork thus defines a single vertical release value and a single lateral release value. It is not possible to adjust the lateral release value independently of the vertical release value, or vice versa. These two release values are therefore directly related and depend on the dimensioning of the fork.

The contact zone 115 is dimensioned so that when the body 130 has a predetermined angular position in relation to the frame 110, the two rods 51, 52 are no longer in contact with the contact zone 115, or are slightly in contact with a respective predetermined portion of the contact zone 115, associated with each rod, to enable withdrawal of the rods 51, 52 out of the contact zone 115 without tools, such as by manual action exerted with only two fingers.

Thus in a particular angular position of the body 130 in relation to the contact zone 115 affixed to the frame 110, the rods 51, 52 do not cooperate with the contact zone 115.

Thus, the fork does not tighten the contact zone 115 and can easily be replaced by another, for example when worn out.

This characteristic is illustrated in FIG. 11. In this figure, the body 130 is rotated by more or less 90° with respect to the descent configuration in which the rods 51, 52 are opposite the housing of the heel 11.

In this position, the contact zone 115 carried by the vertical extension 112 has a surface opposite the rods 51, 52, which is at a distance D3 from the axis of rotation Z1 of the body 130. This distance D3 is dimensioned so that the distance between the two surfaces of the vertical extension 112 is less than the spacing E3 of the ends 53, 54 of the rods 51, 52 at rest, that is to say without being biased into spacing: $2 \times D3 \leq E3$.

In this position, the contact zone 115 does not space apart the rods 51, 52, which can then easily be removed by a simple horizontal sliding movement.

If $2 \times D3$ is very slightly greater than E3, without blocking a horizontal sliding of the fork 50, this remains acceptable because the elastic force is low, with the rods being slightly spaced.

A second embodiment is next described with reference to FIGS. 12 to 18.

This embodiment includes all of the characteristics of the embodiment described above, except for the alternative embodiments described below, which can be reproduced separately or in combination.

A first alternative embodiment relates to the climbing aid 250. In this alternative, the climbing aid 250 is rotationally hinged on the frame 110.

More specifically, it is hinged on the stop 220 constituting an extension of the vertical extension 112 of the frame 110. The hinge axis 251 of the aid 250 is substantially horizontal and transverse in relation to the ski, so that the aid is pivotable from the front to the rear of the heel-piece 100.

The climbing aid 250 is provided on an upper portion 220 of the frame 110, below which at least a portion of the body 130 of the heel-piece pivots about a substantially vertical axis Z1. The body is pivotally mounted about the frame fixed to the gliding board.

In this construction, the frame 110 extends through the body 130 and serves as a bearing for the body 130 for its rotation about a substantially vertical axis Z1.

In this embodiment, the rods 51, 52 ensuring the release of the heel-piece are arranged on both sides of the frame 110 and, more specifically, of the portion extending through the body.

Thus, the climbing aid 250 is made independent of the movement of the body 130. In particular, it is not rotationally driven when the body 130 rotates.

This then makes it possible to maintain the climbing aid 250 in the position, activated or deactivated, given thereto by the user, without risk of an unintended rotation of the body 130 causing the rotation of the climbing aid 250. The operation the climbing aid is completely independent of the angular position of the rotatable body.

Furthermore, because the climbing aid is directly affixed to the frame fixed to the gliding board, if lateral pressure is exerted on the climbing aid, its position remains the same with respect to the gliding board. This lateral pressure can occur when the skier moves along on slopes. The climbing aid is thus continuously functional or non-functional, depending upon the voluntary action of the user, irrespective of the angular position of the body.

Figure 12:
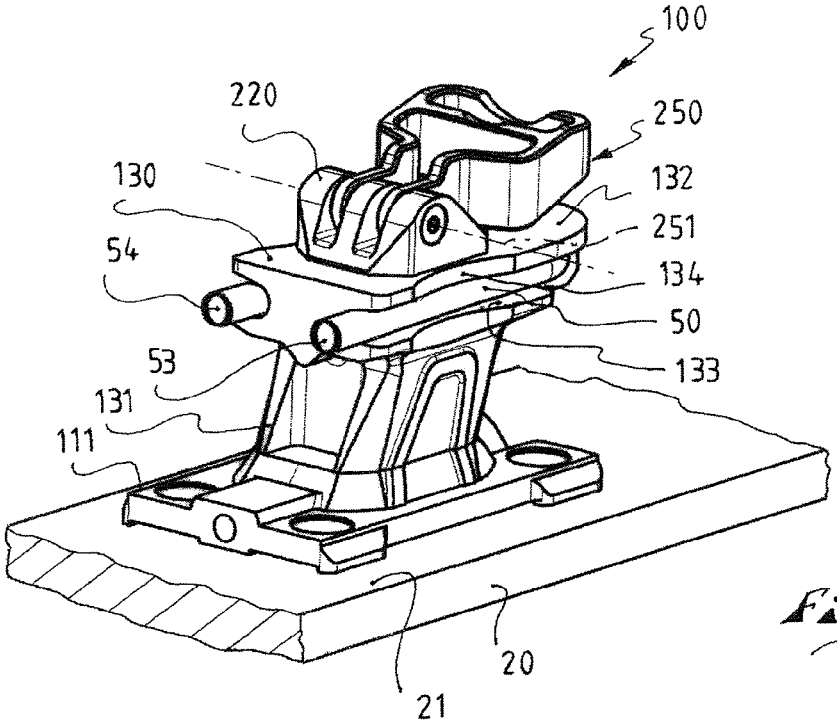
FIGS. 12 to 18 are views of a heel-piece according to a second embodiment of the invention.

FIG. 12 illustrates the climbing aid 250 in a deactivated state.

Figure 13:
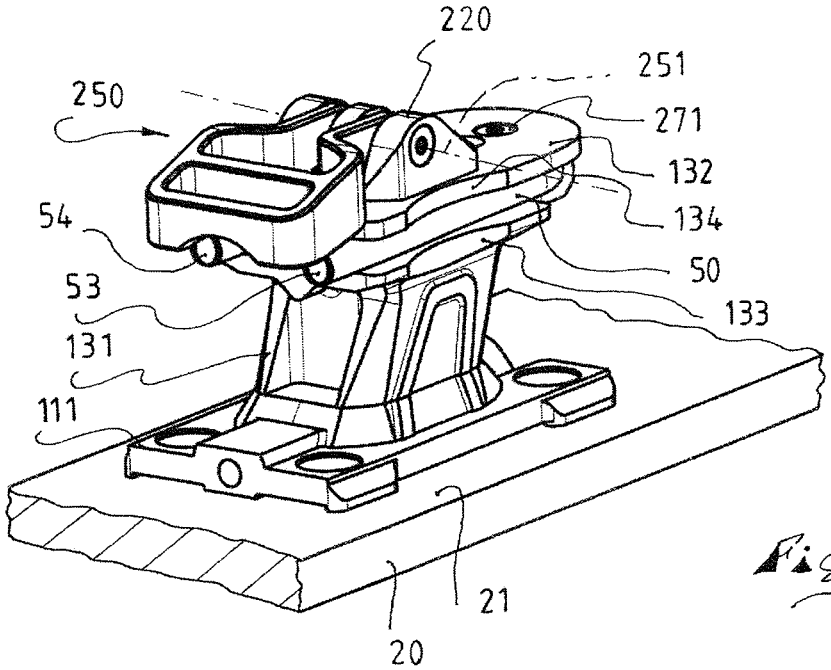

FIG. 13 illustrates the climbing aid 250 in an activated state, with the body 130 in the same position as FIG. 12.

Figure 14:
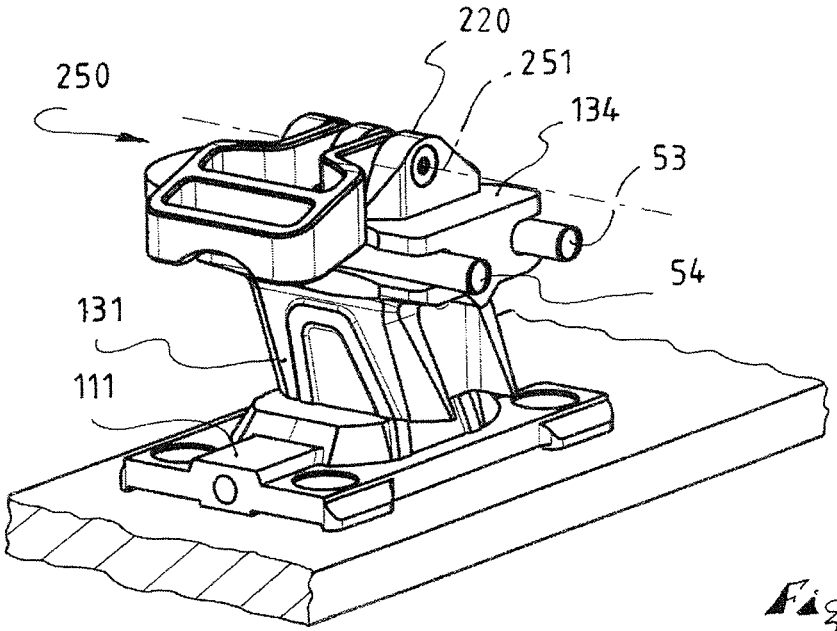

FIG. 14 illustrates the climbing aid 250 in the activated state, with the body 130 having been rotated here by 90° from the position in FIG. 13. The climbing aid 250 then has not been rotated and remains active.

A second alternative embodiment relates to the mechanisms for fixing forks 50 of various lengths while maintaining a constant distance between the ends 53, 54 of the rods 51, 52 and the axis of rotation Z1 of the body 130.

In this second alternate embodiment, the junction portion 55 of a fork 50 is inserted into a holding element 270 attached on the body 130, for example by being fixed to the lower surface of a longitudinal extension 132 of the body 130. In this embodiment, the longitudinal extension 132 forms an extension of the upper flange 134, unlike the first embodiment in which the longitudinal extension 132 forms the extension of the lower flange 133.

This holding element 270 has a groove dimensioned to house at least a portion of the junction portion 55. The holding element 270 is also constructed to prevent horizontal displacement of the fork 50, in particular it sliding parallel to the rods 51, 52.

Furthermore, the cooperation of the holding element 270 with the lower surface of the longitudinal extension 132 of the body 130 demarcates a housing 273 having a closed cross section which prevents any vertical retraction of the fork 50. The latter is therefore blocked when the holding element 270 is fixed to the body 130.

The holding element 270 is fixed by at least one screw 271 or a pin screwed into the body 130.

Advantageously, a set of holding elements 270 is provided, all having a different distance between their housing 273 for the junction portion 55 and the axis of rotation Z1 of the body 130. In a particular embodiment, the same threaded hole 136 provided in the body 130 and the same screw 271 are used to fix all of the holding elements 270, whose distance between the screw 271 and the housing of the junction portion 55 is different.

Using a screwdriver, one can very easily replace the fork 50 and therefore modify the stiffness of the fork 50, thereby making it possible to modify the release thresholds of the heel-piece 100.

Figure 16:
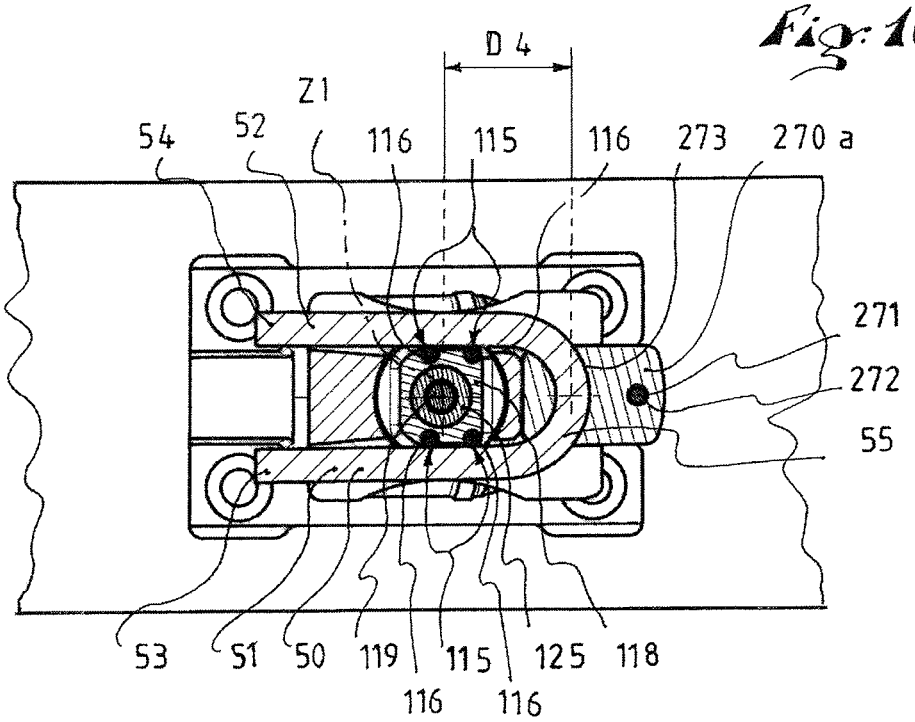
Figure 17:
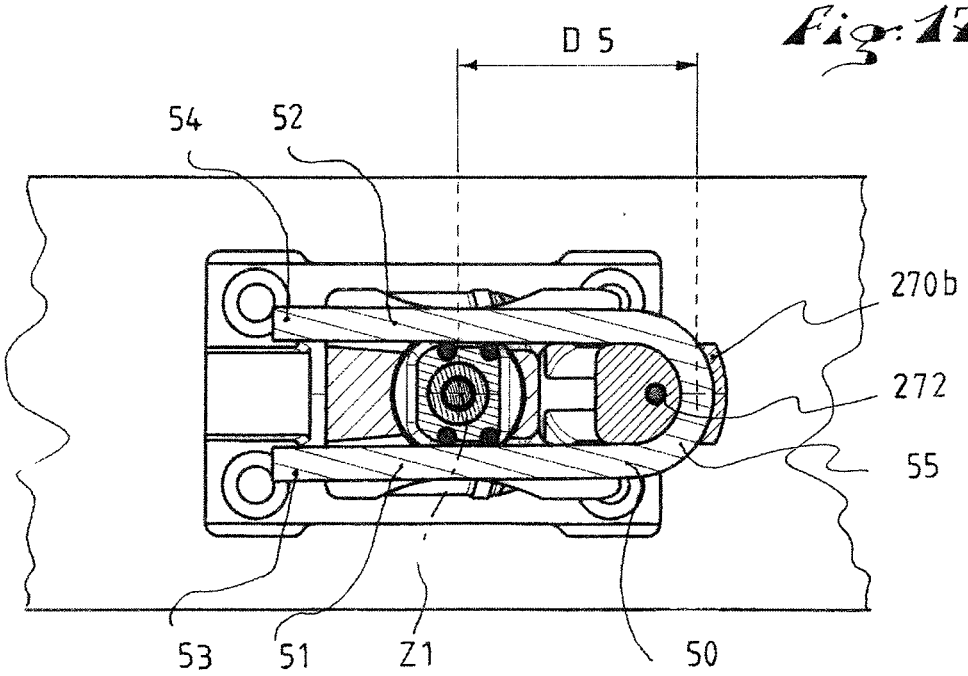

In FIGS. 16 and 17, two holding elements 270*a*, 270*b* are shown, and each exposes a hole 272 for passage of the screw 271.

The holding element 270*a* of FIG. 16 blocks the junction portion 55 at a distance D4 from the axis of rotation Z1 of the body 130.

The holding element 270*b* of FIG. 17 blocks the junction portion 55 at a distance D5 from the axis of rotation Z1 of the body 130, which is very significantly less than D4. This second holding element 270*b* therefore enables the use of a fork 50 provided with longer rods and thus allowing for a lower release threshold.

Figure 15:
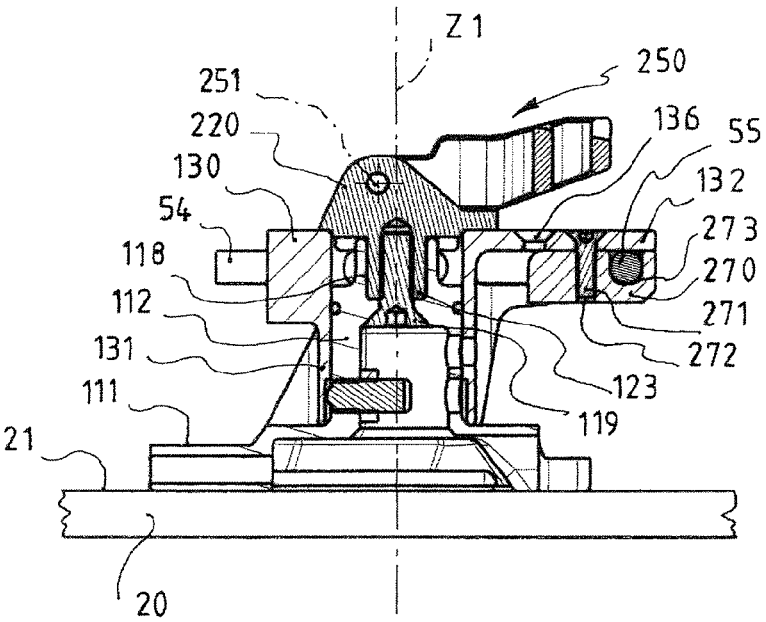
Figure 18:
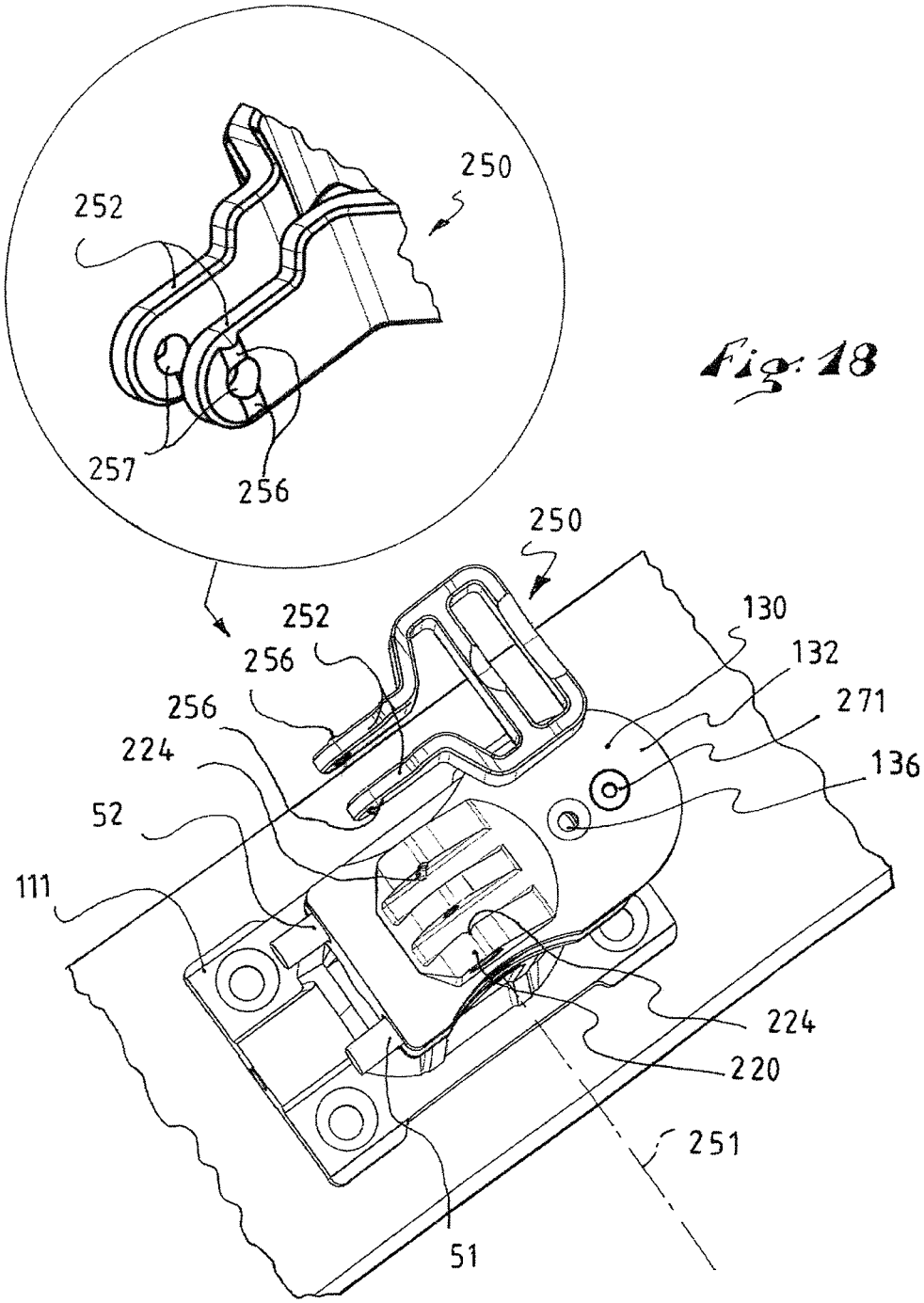

The body may include a plurality of screw holes 136 for passage of the screw 271. These screw holes 136 are aligned longitudinally, thereby increasing the number of possible configurations. FIGS. 15 and 18 illustrate an embodiment with two screw holes 136.

According to an advantageous embodiment, the same holding element 270 comprises two housings arranged on the same surface of the holding element 270 or on two opposite surfaces. In the latter case, it then suffices to invert the holding element 270 in order to use forks 50 of different dimensions.

The holding elements 270 can also have housings of various cross sections to receive forks 50 of various cross-sections.

According to an alternative embodiment illustrated in FIG. 18, the climbing aid 250 comprises an indexing mechanism for indexing the angular position. The user can thus more easily position it in either one of the activated and deactivated positions. Furthermore, this indexing prevents the climbing aid 250 from pivoting unintentionally from a position assigned thereto by the user.

For example, the indexing is ensured by:

- a projection 256 carried by the climbing aid 250, in the area of the free end of an arm 252 of the aid. The projection 256 is positioned on an outer surface of the arm oriented outward, as opposed to the inner surface of the arm oriented towards the other arm. The projection is positioned such that, when the climbing aid is in its deactivated position, the projection forms a boss extending substantially vertically from a hole 257, within which a shaft defining the hinge axis 251 passes, up to the edge of the arm 252;
- a groove 224, complementary in shape to the projection, carried by the element on which the climbing aid 250 is hinged, i.e., the stop 220 of the frame 110 in the embodiment illustrated of FIG. 18. The groove 224 extends substantially vertically on both sides of a hole within which the shaft defining the hinge axis 251 passes.

Furthermore, the arms 256 are mounted on the stop 220 with a transverse clearance so as to allow for a slight deformation of the arm along a direction transverse to the ski.

When the climbing aid is in its deactivated position, the projection 256 is housed in a first portion of the groove 224 (the upper portion or the lower portion). This configuration is stable and indexed.

When the user rotates the aid, the projection 256 exits the groove 224; such action causes a slight radial deformation of the arm 256. This configuration is not indexed and is unstable.

When the aid reaches its activated position, the projection is housed in a second portion of the groove 224 (the lower portion or the upper portion). This configuration is stable and indexed.

This indexing operates with a single projection 256. Alternatively, there can be two projections on the same outer surface of an arm 252, namely a projection on both sides of the hole 257. In an alternative embodiment, the second arm 252 of the climbing aid 250 also includes one or two projections cooperating with a complementary second groove carried by the stop.

The embodiment shown in FIG. 18 has four projections, two outer projections per arm.

The angular orientation of the groove is not necessarily substantially vertical. For example, it may be horizontal. The bosses are then oriented differently accordingly.

Once the aid 250 is positioned by the user in one of its operating positions, a force sufficient to elastically deform the aid 250 must then be exerted on the aid 250, in the area of the projection 256. This force makes it possible to reduce ill-timed rotations of the aid 250 and to help the user to achieve the desired position for the aid 250. This is particularly useful when the user wishes to change the position of the aid 250 with a pole or with gloves hindering the accuracy of his movement.

In a particular embodiment, the aids 250 are made from a profiled element, and the projection 256 extends in the main axis of the profiled element, typically the direction of extension of the arms 252. This makes it possible to simplify the element manufacturing operations.

Other indexing types are within the scope of the invention. For example, such indexing arrangements can comprise a system of cams.

According to an alternative embodiment that can be applied to any of the previously described embodiments, the heel-piece 100 comprises a pair of heel lifts 150. The two heel lifts 150 are hinged about their respective axes of rotation, these two axes being offset or aligned along a longitudinal direction.

The shape of the heel lifts 150 and the offset or non-offset with respect to their axes of rotation allow for a number of forms of combination. For example, they may or may not support one another to obtain various support angles for the boot 10.

In view of the foregoing description, it is clearly apparent that the invention provides a particularly robust and light-weight solution to ensure vertical and lateral releases of the heel-piece 100. In addition, the release values can very easily be changed by simply replacing the energizing mechanisms. The wear on the heel-piece 100 is localized on simple replaceable elements, which facilitates the after-sales service and increases the useful life of the entire system. Furthermore, the user can easily activate and deactivate the climbing aid 150, 250, and the risks of inadvertent modification of the position of the climbing aid 150, 250 are avoided.

In the preceding embodiments, the climbing aid is assembled to be pivotable. Alternatively, the positioning of the climbing aid can result from a translation instead of a rotation, or from a combination of translational and rotational movement.

According to the previous examples, the release device comprises a U-shaped fork defining both the vertical release and the lateral release. The release force of this device can be characterized by the elasticity of the junction portion connecting the two rods/arms. The junction portion corresponds to the holding mechanism within the meaning of the invention.

Alternatively, the invention is applicable to other release mechanisms. For example, it may be a mechanism comprising two separate rods, pivoting about a first end, the rods being constrained by a tightening device exerting a force on the rods to bring their free ends closer together. In this case, this device comprises at least one elastic mechanism for providing the bringing together force required. The tightening device then corresponds to the holding mechanism within the meaning of the invention. Such a construction is described, for example, in the document AT 402020 or WO 2012/024809. The invention involves each rod cooperating with a specific portion of a contact zone associated with the rod, so that the rotation of the body supporting the rods causes the spacing of the ends of the rods.

With respect to the climbing aid provided on the frame extending through the body rotatable about a substantially vertical axis, this construction can be applicable to other release mechanisms. For example, the climbing aid can be transposed to a heel-piece having a lateral release mechanism separate from the vertical release mechanism, such as the heel-pieces described in the documents EP 2 608 853 or EP 259 850, for example. It is also applicable to heel-pieces having only one vertical release mechanism, but in which the body supporting the mechanism is rotatably mounted on a frame. It is applicable to a heel-piece having only one lateral release mechanism. It is also applicable to a heel-piece, the release mechanism of which comprises other mechanisms for interfacing with the boot. For example, the interface mechanism may be a jaw instead of rods.

The invention is not limited to these embodiments. It is also possible to combine these embodiments.

The invention also extends to all of the embodiments covered by the annexed claims.

Further, at least because the invention is disclosed herein in a manner that enables one to make and use it, by virtue of the disclosure of particular exemplary embodiments of the invention, the invention can be practiced in the absence of any additional element or additional structure that is not specifically disclosed herein.

The invention claimed is:

1. A heel-piece for binding a boot on a gliding board comprising:

a frame configured to be fixed to the gliding board, the frame comprising a vertical extension;

a body rotatably mounted about the vertical extension;

at least two rods supported by the body, the two rods extending on respective sides of the vertical extension;

each of the two rods having a respective free end configured to cooperate with a housing provided in the heel of the boot;

a holding mechanism maintaining a predetermined spacing between the free ends;

the vertical extension supporting at least one contact zone, the latter being fixed against movement in relation to the frame;

each of the two rods being configured to cooperate with a respective predetermined portion of the at least one contact zone, specific to each said rod; and the at least one contact zone being configured such that a rotation of the body about the extension, from a descent configuration of the heel-piece, causes a relative spacing apart of the two free ends greater than the predetermined spacing.

2. A heel-piece according to claim 1, wherein:

the two rods and the holding mechanism form a unitary element.

3. A heel-piece according to claim 2, wherein:

the body comprises an assembly mechanism configured to alternatively affix any one of a plurality of unitary elements, the plurality of unitary elements having respective different rod lengths, to the body, while maintaining an identical predetermined distance between the free ends and an axis about which the body rotates.

4. A heel-piece according to claim 3, wherein:

the assembly mechanism is configured to be deactivated when the body is positioned in at least one predetermined angular position in relation to the frame;

the assembly mechanism allows withdrawal of the unitary element only when the assembly mechanism is deactivated; and the heel-piece is configured to prevent deactivation of the assembly mechanisms when the body is not in said at least one predetermined angular position.

5. A heel-piece according to claim 2, wherein:

the unitary element constitutes a U-shaped fork.

6. A heel-piece according to claim 2, further comprising:

a holding element attached to the body; and the unitary element is positioned within the holding element.

7. A heel-piece according to claim 1, further comprising:

a climbing aid provided on an upper portion of the frame; and at least a portion of the body pivots below the upper portion of the frame.

8. A heel-piece according to claim 7, wherein:

the upper portion of the frame is an extension of the vertical extension.

9. A heel-piece according to claim 1, wherein:

the contact zone is dimensioned such that when the body is positioned in at least one predetermined angular position in relation to the frame, each said rod either no longer cooperates with the contact zone or slightly cooperates with an associated portion of the contact zone that enables manual withdrawal of the rod out of the contact zone.

10. A heel-piece according to claim 1, further comprising:

a movable climbing aid configured to be placed in a predetermined position in relation to the two rods to limiting the relative spacing apart of the two free ends of the two rods.

11. A heel-piece according to claim 1, further comprising:

a climbing aid comprising an indexing mechanism configured to maintain the climbing aid in a stable position.

12. A heel-piece according to claim 1, wherein:

each of the two rods and the respective predetermined portion of the contact zone thereof are located at respective identical heights.

13. A heel-piece according to claim 1, wherein:

the vertical extension of the frame extends through the body; and the two rods that are arranged on the respective sides of the vertical extension extend through the body.

14. A heel-piece according to claim 1, wherein:

each of the two rods being configured to cooperate with a respective predetermined portion of the at least one contact zone, specific to each said rod comprises each of the two rods being configured to be in contact with a respective predetermined portion of the at least one contact zone, specific to each said rod.

15. A gliding assembly comprising:

a gliding board; and a heel-piece comprising:

a frame configured to be fixed to the gliding board, the frame comprising a vertical extension;

a body rotatably mounted about the vertical extension;

at least two rods supported by the body, the two rods extending on respective sides of the vertical extension;

each of the two rods having a respective free end configured to cooperate with a housing provided in the heel of the boot;

a holding mechanism maintaining a predetermined spacing between the free ends;

the vertical extension supporting at least one contact zone, the latter being fixed against movement in relation to the frame;

each of the two rods being configured to cooperate with a respective predetermined portion of the at least one contact zone, specific to each said rod; and the at least one contact zone being configured such that a rotation of the body about the extension, from a descent configuration of the heel-piece, causes a relative spacing apart of the two free ends greater than the predetermined spacing.

16. A gliding assembly according to claim 15, wherein:

each of the two rods being configured to cooperate with a respective predetermined portion of the at least one contact zone, specific to each said rod comprises each of the two rods being configured to be in contact with a respective predetermined portion of the at least one contact zone, specific to each said rod.

17. A system for binding a boot on a gliding board, said system comprising:

a toe-piece configured to affix the front of the boot to the gliding board; and a heel-piece comprising:

a frame configured to be fixed to the gliding board, the frame comprising a vertical extension;

a body rotatably mounted about the vertical extension;

at least two rods supported by the body, the two rods extending on respective sides of the vertical extension;

each of the two rods having a respective free end configured to cooperate with a housing provided in the heel of the boot;

a holding mechanism maintaining a predetermined spacing between the free ends;

the vertical extension supporting at least one contact zone, the latter being fixed against movement in relation to the frame;

each of the two rods being configured to cooperate with a respective predetermined portion of the at least one contact zone, specific to each said rod; and the at least one contact zone being configured such that a rotation of the body about the extension, from a descent configuration of the heel-piece, causes a relative spacing apart of the two free ends greater than the predetermined spacing.

18. A system for binding a boot on a gliding board according to claim 17, wherein:

each of the two rods being configured to cooperate with a respective predetermined portion of the at least one contact zone, specific to each said rod comprises each of the two rods being configured to be in contact with a respective predetermined portion of the at least one contact zone, specific to each said rod.

* * * * *